US007059671B1

(12) United States Patent
Coggins

(10) Patent No.: US 7,059,671 B1
(45) Date of Patent: Jun. 13, 2006

(54) APPARATUS FOR MODIFIED CHAIR WITH COOLING AIR JETS

(76) Inventor: Frank C. Coggins, 3831 Crawford Ave., Miami, FL (US) 33133

( * ) Notice: Subject to any disclaimer, the term of this patent is extended or adjusted under 35 U.S.C. 154(b) by 0 days.

(21) Appl. No.: 11/107,476

(22) Filed: Apr. 18, 2005

(51) Int. Cl.
*A47C 7/74* (2006.01)

(52) U.S. Cl. ..... 297/180.14; 297/180.15

(58) Field of Classification Search ..... 297/180.11, 297/180.13, 180.14, 180.15; 454/120, 907
See application file for complete search history.

(56) References Cited

U.S. PATENT DOCUMENTS 3,295,886 A 1/1967 Goldmerstein
3,625,434 A 12/1971 Ritover
4,141,585 A 2/1979 Blackman
5,000,384 A 3/1991 Arnold
5,301,457 A 4/1994 Seely
D362,555 S 9/1995 Andrews
6,048,024 A * 4/2000 Wallman ..... 297/180.14
6,062,641 A * 5/2000 Suzuki et al. ..... 297/180.1
6,224,150 B1 * 5/2001 Eksin et al. ..... 297/180.1
6,619,736 B1 * 9/2003 Stowe et al. ..... 297/180.14
6,676,207 B1 * 1/2004 Rauh et al. ..... 297/180.14
6,685,553 B1 * 2/2004 Aoki ..... 454/120

* cited by examiner

*Primary Examiner*—Peter R. Brown

(57) ABSTRACT

The Modified Chair with Cooling Air Jets can be used to fulfill the need to provide a cooling mechanism for a person using a beach or lounge chair for relaxation purposes. Cool air is blown using fans into the framework of this modified chair and is dispensed through a series of jet spouts in the framework, thus cooling the person lying or sitting on the chair.

1 Claim, 5 Drawing Sheets

APPARATUS FOR MODIFIED CHAIR WITH COOLING AIR JETS

1. FIELD

The present disclosure pertains to an apparatus for Modified Chair with Cooling Air Jets, in particular to fulfill the need for a modified relining lawn or lounge chair that features a an air spraying apparatus incorporated into its design that improves the comfort of the person using the chair.

2. DESCRIPTION OF RELATED ART

The persistent need for an efficient method to provide comfort and cool soothing air to a person using a chair at the lawn, beach or lounge is understood by any person living or visiting places with warm weather. Various methods have been invented in the past to provide a method to easily access baby accessories:

Some of the prior patents are U.S. Pat. Nos. 4,141,585, 3,625,434, 5,301,457, 3,295,886, Des. 362,555.

However, it has been found that the inventions related to prior patents are structurally and functionally different than the present one. For example, some of the prior patents use complex air blowing systems to circulate air around the chair. Some other prior patents require some kind of coolant material to provide the cool air. Yet another prior patent requires cool water to make the circulating air cool.

3. BRIEF DESCRIPTION OF THE FIGURES

Figure 1:
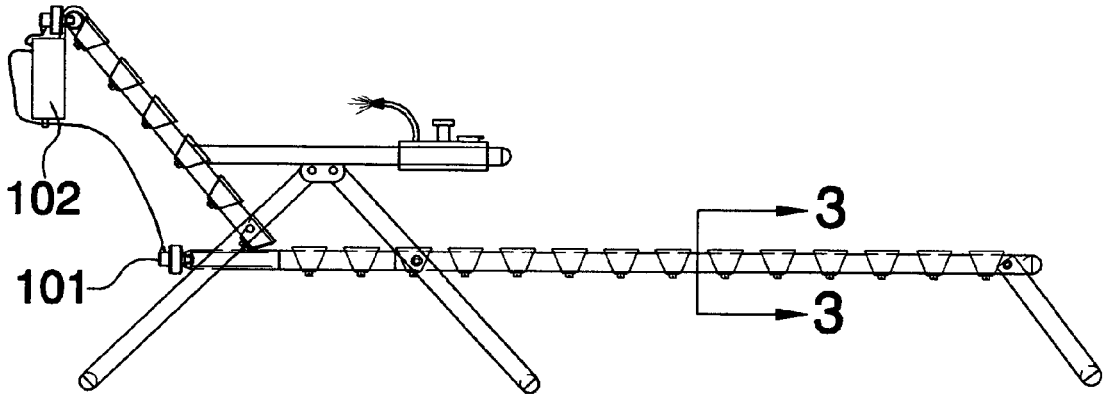

The present invention is illustrated by way of an example and is not limited by the figures presented in the following sections:

FIG. 1 illustrates the prototype of one type of the embodiment, which is the Modified Chair with Cooling Air Jets. It shows the side view of the embodiment, which is the Modified Chair with Cooling Air Jets. FIG. 1 illustrates the present invention, which is the modified chair 100 along with the fan 101 and the rechargeable batteries 102.

Figure 2:
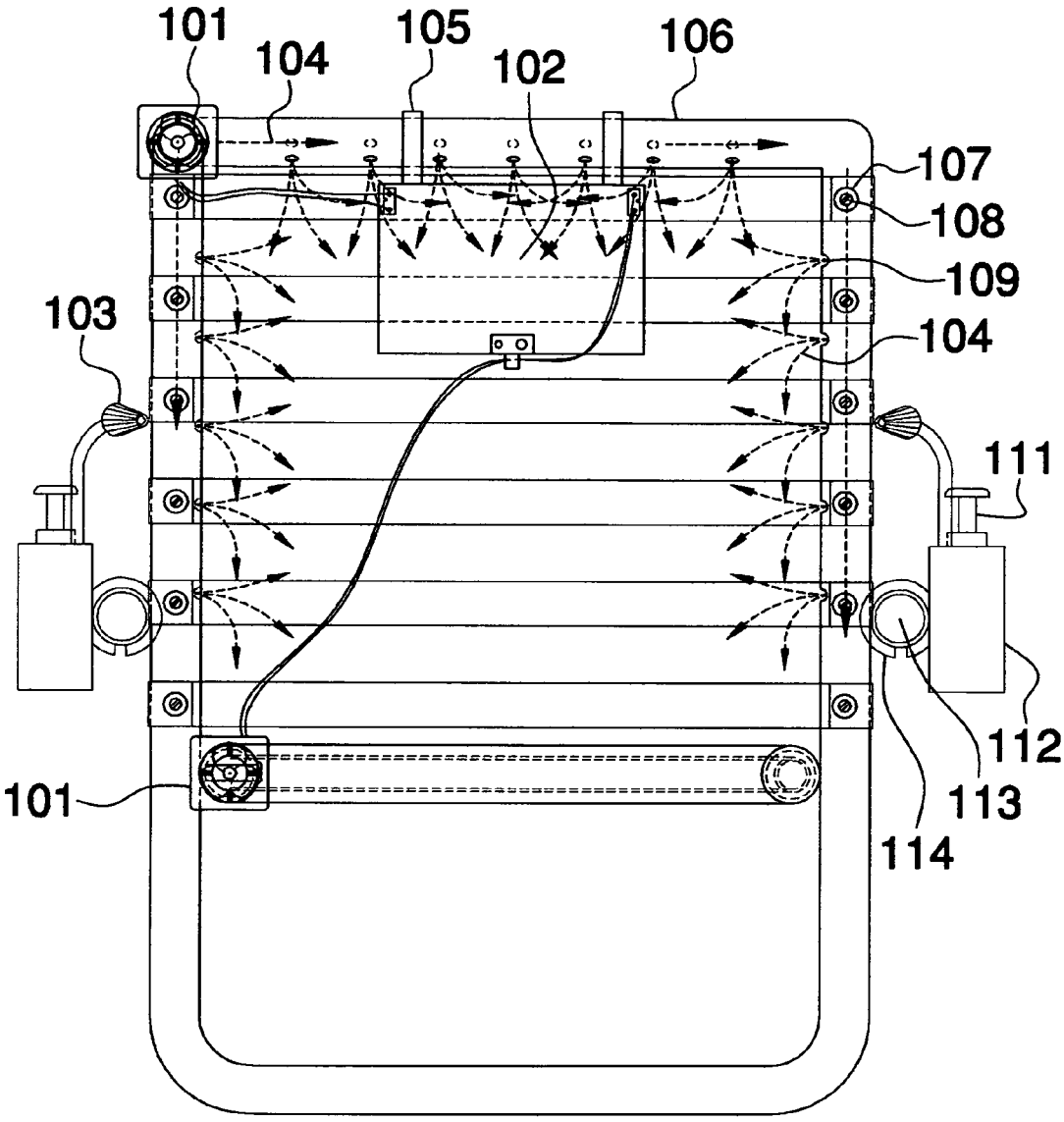

FIG. 2 illustrates the top view of the embodiment in the folded position, which is the Modified Chair with Cooling Air Jets shown in FIG. 1. FIG. 2 illustrates the present invention, which is the modified chair 100 displayed with the various parts such as two fans 101 on two sides, rechargeable battery pack 102, air nozzle 103, hook 105, tubular frame 106, washer 107, screw 108, pump 111, reservoir 112, armrests 113, and mount 114. This figure also illustrates the direction of airflow 104 and the air jet 109 blowing out from the air hose 115 inside the tubular frame 106.

Figure 3:
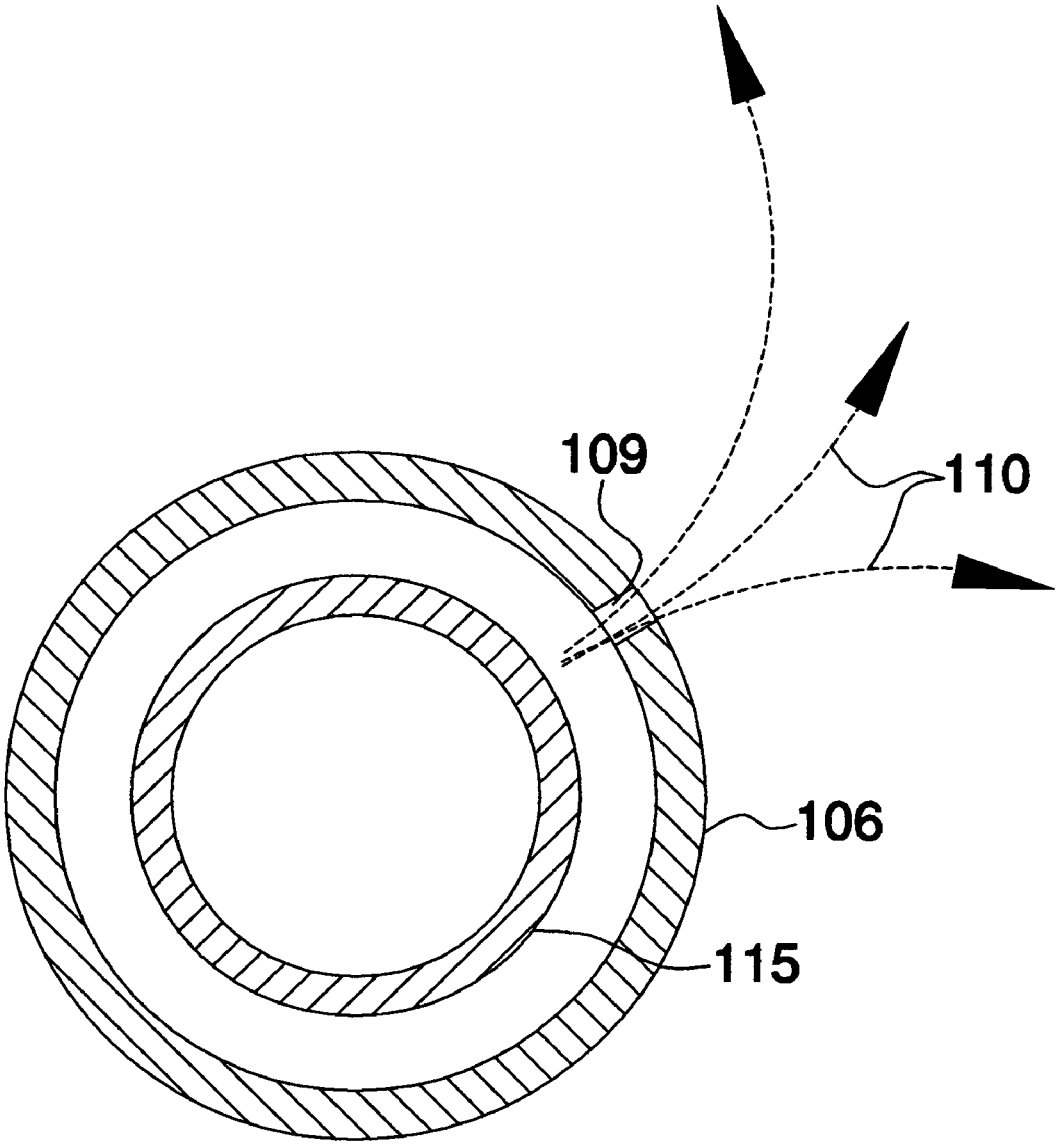

FIG. 3 illustrates the cross-sectional view of the tubular frame 106 of the embodiment, which is the Modified Chair with Cooling Air Jets shown in FIG. 1. FIG. 3 illustrates the cross-section of the tubular frame 106 and shows the air hose 115 embedded inside the hollow tubular frame 106 and airflow 110 that comes out from the jet 109.

Figure 4:
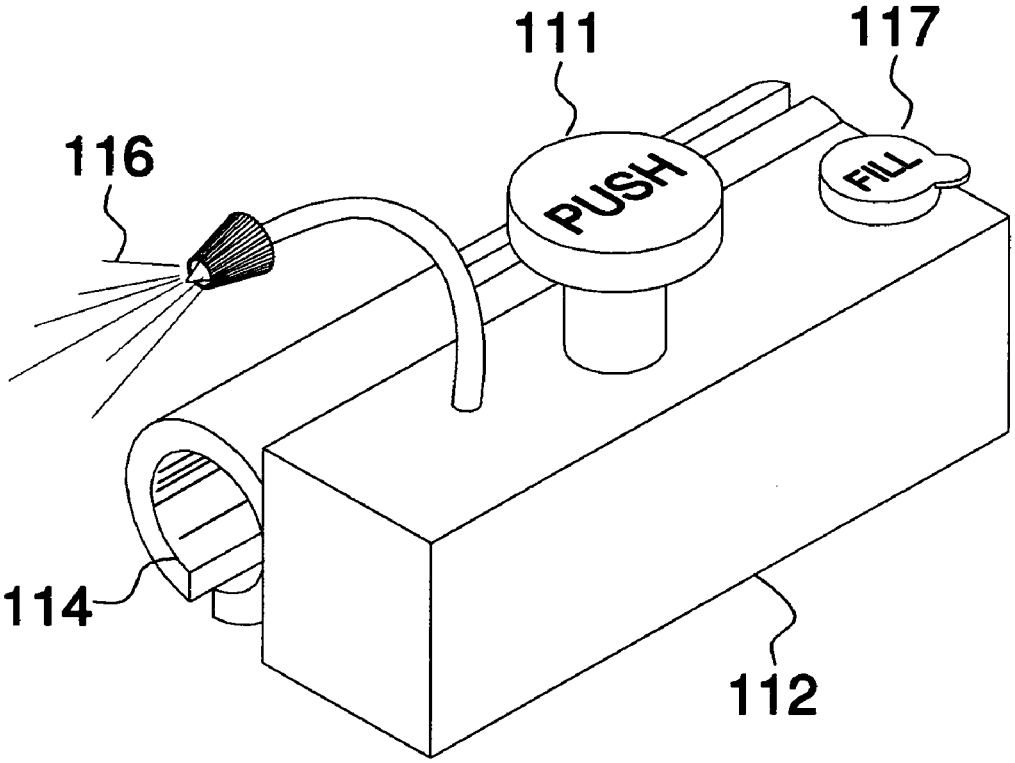

FIG. 4 illustrates the isometric view of the reservoir tank unit of the embodiment, which is the Modified Chair with Cooling Air Jets. FIG. 4 illustrates the reservoir 112, which is mounted on to the chair through the mount 114 and the other parts displayed are the pump 111 and the fill spout 117 and the spray nozzle 114.

Figure 5:
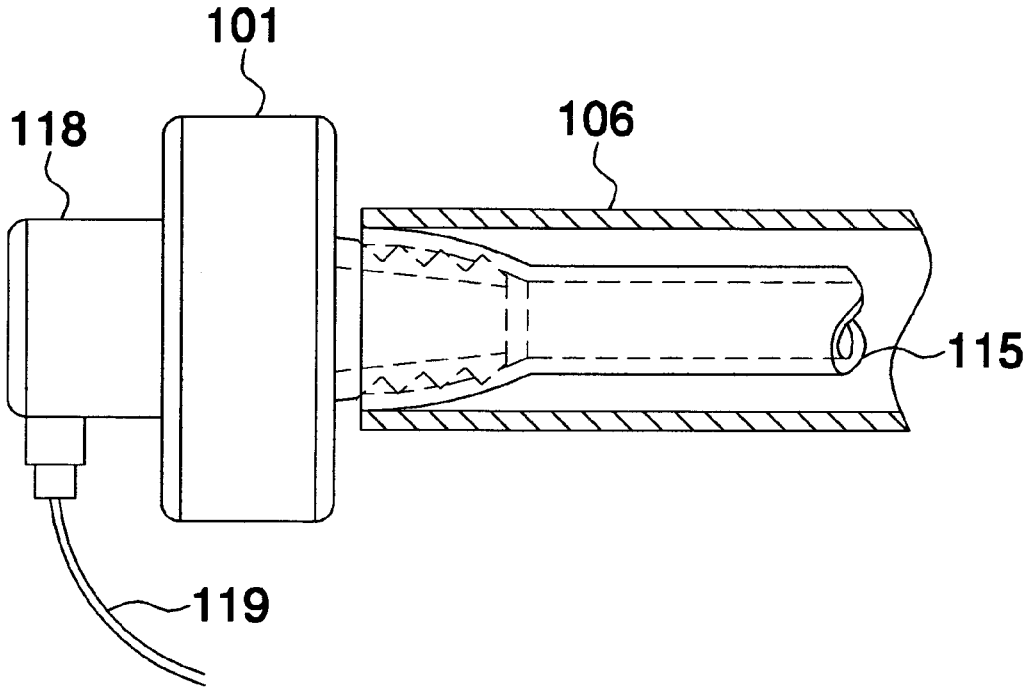

FIG. 5 illustrates the side view of the motor 118 and the tubular frame 106 of the embodiment, which is the Modified Chair with Cooling Air Jets. FIG. 5 illustrates the side view of the motor 118 and the tubular frame 106 of the embodiment, along with the fan 101, power line 119 and the air hose 115.

4. DETAILED DESCRIPTION

The following description provides an apparatus for Modified Chair with Cooling Air Jets, in particular to provide a modified relining lawn or lounge chair that features a blowing and cooling apparatus that improves the comfort of the person using the chair. The following sections provide a description of the apparatus for Modified Chair with Cooling Air Jets, its specific details, its features and its advantages over the other prior models.

As previously discussed, some of the prior patents have designs that use complex air blowing systems to circulate air around the chair. Some other prior patents require some kind of coolant material to provide the cool air. Yet another prior patent requires cool water to make the circulating air cool. In contrast, the apparatus described as an embodiment in FIG. 1 is structurally different from all prior patents and endeavors to overcome the limitations faced by prior patents. It is an object of the present invention is to provide a modified chair with a cooling mechanism associated with it. Another object of this invention is to provide a compact and portable chair that provides cool refreshing air to the user. Another object of this invention is to provide consistent amounts of cool air in a soothing manner focusing along the length of the user's body. Yet another object of this invention is to allow the user to feel refreshed and relaxed while using the chair for various purposes such as sun bathing, or simply reclining in a chair. Another object of this invention is to allow the air to blow over the skin of a person sunbathing in the chair, and making the perspiration evaporate and thus effectively cool the user's body. It is another object of this invention to be versatile such that the present invention could be used in various places such as public swimming pools, water parks, hotels, resorts or cruise ships. In one embodiment, a hose with air jets is inserted into the tubular hollow frame and when the battery-operated motor is turned on the air in the reservoir is made cool through the fans and the cool air is forced through the nozzle into the hose with jets. The cool air is forced out of the jets and out of the tubular frame onto the surface of the body of the user.

The apparatus for Modified Chair with Cooling Air Jets, described in the present invention is easy to manufacture, is easy to use, has a simple design, is practical, is convenient, is durable, provides comfort to the user and can be produced in different colors, sizes, and shapes.

DETAILED DESCRIPTION OF THE FIGURES

FIG. 1 illustrates the prototype of one type of the embodiment, which is the Modified Chair with Cooling Air Jets. It shows the side view of the embodiment, which is the Modified Chair with Cooling Air Jets. FIG. 1 illustrates the present invention, which is the modified chair 100 along with the fan 101 and the rechargeable batteries 102. If produced, the modified chair would be produced using plastic and vinyl strapping. In one embodiment, the tubular framework 106 encloses the sitting and the lying down area and is hollow in structure. The rechargeable batteries 102 are enclosed in a casing, which is attached to the back of the chair. The fans 101 are connected at the base of the both the tubular frames 106 and are powered through the motor 118. The fans 101 cool the air that is blown into the tubular frames 106 through the air nozzle 103.

FIG. 2 illustrates the top view of the embodiment in the folded position, which is the Modified Chair with Cooling Air Jets shown in FIG. 1. FIG. 2 illustrates the present invention, which is the modified chair 100 displayed with the various parts such as two fans 101 on two sides, rechargeable battery pack 102, air nozzle 103, hook 105, tubular frame 106, washer 107, screw 108, pump 111, reservoir 112, armrests 113, and mount 114. This figure also illustrates the direction of airflow 104 and the air jet 109 blowing out from the air hose 115 inside the tubular frame 106. The hollow design of the tubular frame 106 allows the insertion of the air hose 115. The rechargeable battery pack 102 resides in a casing and is attached to the back of the chair using hooks 105. The fans 101 are connected at the base of the both the tubular frames 106 and are powered through the motor 118. The fans 101 cool the air that is blown into the tubular frames 106 through the air nozzle 103. The air is supplied through a reservoir 112 placed at the base of both the armrests 113 using mounts 114. In one embodiment, the each reservoir 112 has a pump 111 attached, which can be used to pump air into the air hose 115 through the air nozzle 103. The air is then cooled using the fans 101 and is circulated inside the tubular framework 106. A washer 107 and screw 108 is used to attach the plastic or vinyl strapping to the tubular framework 106.

FIG. 3 illustrates the cross-sectional view of the tubular frame 106 of the embodiment, which is the Modified Chair with Cooling Air Jets shown in FIG. 1. FIG. 3 illustrates the cross-section of the tubular frame 106 and shows the air hose 115 embedded inside the hollow tubular frame 106 and airflow 110 that comes out from the jet 109. The hose 115 enables the movement of air through the tubular framework 106 and is eventually dispensed through series of jets 109 lining the perimeter of the chair.

FIG. 4 illustrates the isometric view of the reservoir tank unit of the embodiment, which is the Modified Chair with Cooling Air Jets. FIG. 4 illustrates the reservoir 112, which is mounted on to the chair through the mount 114 and the other parts displayed are the pump 111 and the fill spout 117 and the spray nozzle 114. The air is supplied through a reservoir 112 placed at the base of both the armrests 113 using mounts 114. In one embodiment, the each reservoir 112 has a pump 111 attached, which can be used to pump air into the air hose 115 through the air nozzle 103. The pump 111 can be operated using a series of operation where it is pushed down are released. The reservoir 112 can be filled with air using the fill spout 117 simply by removing the cap.

FIG. 5 illustrates the side view of the motor 118 and the tubular frame 106 of the embodiment, which is the Modified Chair with Cooling Air Jets. FIG. 5 illustrates the side view of the motor 118 and fan 101 along with the tubular frame 106 of the embodiment, power line 119 and the air hose 115. The fans are powered through the rechargeable batteries 102 and are connected to the batteries 102 through power line 119. The fans 101 cool the air and send the air into the tubular frame 106 through an air hose 115. The cool air is then dispensed through jet spouts 109 in the tubular framework 106.

While certain exemplary embodiments have been shown and described in the accompanying drawings, it is to be understood that such embodiments are merely illustrative of and not restrictive on the broad invention, and that this invention not be limited to the specific constructions and arrangements shown and described, since various other modification may occur to those ordinarily skilled in the art upon studying this disclosure.

The invention claimed is:

1. A lounge chair comprising:

a tubular shaped frame with an air hose in a cavity of the tubular shaped frame;

a first and a second fans coupled to the tubular shaped frame to circulate an air flow within the air hose, the air flow to be dispensed out from a plurality of vent holes in the tubular shaped frame;

a battery pack to store a plurality of batteries mounted to the tubular frame to supply power to the first and second fans; and a first and a second reservoir with a cavity, mounted to the tubular frame, the air flow to be generated by depressing a pump lever to be dispensed via a nozzle on each reservoir in addition to being dispensed throughout the plurality of vent holes.

* * * * *